US010062484B2

(12) United States Patent
Navarro Perez et al.

(10) Patent No.: US 10,062,484 B2
(45) Date of Patent: Aug. 28, 2018

(54) FLEXIBLE SOFT MAGNETIC CORE, ANTENNA WITH FLEXIBLE SOFT MAGNETIC CORE AND METHOD FOR PRODUCING A FLEXIBLE SOFT MAGNETIC CORE

(71) Applicant: PREMO, S.L., Campanillas, MA (US)

(72) Inventors: Francisco Ezequiel Navarro Perez, Bobadilla Estacion Antequera (ES); Antonio Rojas Cuevas, Malaga (ES)

(73) Assignee: PREMO, S.L., Campanillas (ES)

( * ) Notice: Subject to any disclaimer, the term of this patent is extended or adjusted under 35 U.S.C. 154(b) by 3 days.

(21) Appl. No.: 15/509,055

(22) PCT Filed: Jul. 24, 2015

(86) PCT No.: PCT/IB2015/001238
§ 371 (c)(1),
(2) Date: Mar. 6, 2017

(87) PCT Pub. No.: WO2016/038434
PCT Pub. Date: Mar. 17, 2016

(65) Prior Publication Data

US 2017/0263358 A1 Sep. 14, 2017

(30) Foreign Application Priority Data

Sep. 9, 2014 (EP) ..... 14003109

(51) Int. Cl.
*H01Q 7/08* (2006.01)
*H01F 3/06* (2006.01)
(Continued)

(52) U.S. Cl.
CPC ..... *H01F 3/06* (2013.01); *H01F 1/14766* (2013.01); *H01F 41/0206* (2013.01); *H01Q 1/02* (2013.01);
(Continued)

(58) Field of Classification Search
CPC H01Q 1/02; H01Q 1/085; H01Q 1/36; H01Q 7/08
See application file for complete search history.

(56) References Cited

U.S. PATENT DOCUMENTS 5,159,347 A 10/1992 Osterwalder
5,408,243 A * 4/1995 D'Hont ..... G06K 19/07749 29/600
(Continued)

FOREIGN PATENT DOCUMENTS

| | | |
|---|---|---|
| EP | 0554581 | 5/1997 |
| EP | 1689029 | 8/2006 |
| WO | 20120101034 | 8/2012 |

OTHER PUBLICATIONS

International Search Report and written opinion of PCT/IB2015/001238 dated Nov. 10, 2015.
(Continued)

*Primary Examiner* — Hoang Nguyen

(57) ABSTRACT

The flexible soft magnetic core (1) includes parallel continuous ferromagnetic wires (4) embedded in a core body (2) made of the polymeric medium (3). The continuous ferromagnetic wires (4) extend from one end to another end of said core body (2), are spaced apart from each other and are electrically isolated from each other by the polymeric medium (3). The method for producing the flexible soft magnetic core (1) comprises embedding continuous ferromagnetic wires (4) into an uncured polymeric medium (3) by means of a continuous extrusion process, curing the polymeric medium (3) with the continuous ferromagnetic wires (4) embedded therein to form a continuous core precursor (10), and cutting said continuous core precursor (10) into discrete magnetic cores (1).

20 Claims, 4 Drawing Sheets

(51) Int. Cl.

| | |
|---|---|
| ***H01F 1/147*** | (2006.01) |
| ***H01F 41/02*** | (2006.01) |
| ***H01Q 1/08*** | (2006.01) |
| ***H01Q 1/36*** | (2006.01) |
| ***H01Q 1/02*** | (2006.01) |

(52) U.S. Cl.
CPC ..... *H01Q 1/085* (2013.01); *H01Q 1/36* (2013.01); *H01Q 7/08* (2013.01)

(56) References Cited

U.S. PATENT DOCUMENTS

| | | | |
|---|---|---|---|
| 5,638,080 | A | 6/1997 | Orthmann et al. |
| 2006/0022886 | A1 | 2/2006 | Hein et al. |
| 2009/0078359 | A1 | 3/2009 | Boulay |
| 2009/0265916 | A1 | 10/2009 | Herzer |

OTHER PUBLICATIONS

IPRP of PCT/IB2015/001238 of PCT/IB2015/001238 dated Aug. 11, 2016.
Search report of European patent application No. 14003109.7 dated Feb. 11, 2015.

* cited by examiner

FLEXIBLE SOFT MAGNETIC CORE, ANTENNA WITH FLEXIBLE SOFT MAGNETIC CORE AND METHOD FOR PRODUCING A FLEXIBLE SOFT MAGNETIC CORE

RELATED APPLICATIONS

This application is a U.S. national phase application of international application No. PCT/162015/001238, filed 24 Jul. 2015, which designates the US and claims priority to Spanish Application No. 14003109.7 filed 9 Sep. 2014, the contents of each of which are hereby incorporated by reference as if set forth in their entireties.

FIELD OF THE INVENTION

This invention aims to solve the problem of the fragility of the magnetic cores of long inductive devices used in electronics either as chokes, inductors or LF antennae from 1 KHz to 13.56 MHz mostly used in RFID application in automotive with extensive use for keyless entry systems at 20 KHz, 125 KHz and 134 KHz, extended but not limited to the applications for NFC at frequencies in the range of 13.56 MHz.

For this purpose in a first aspect the invention provides a flexible soft magnetic core that can withstand impacts, flexion and torsion with deformation but without breaking the core thus keeping the magnetic properties when the flexion or torsion efforts disappear.

The flexible soft magnetic core of the invention can also be used for inducers and electric transformers for energy storage and conversion or filtering.

The flexible soft magnetic core of this invention comprises elongated ferromagnetic elements embedded in polymeric medium, and more particularly continuous ferromagnetic flexible wires embedded in the polymeric medium and is intended to replace a very fragile core of ferrite that is presently very common in the field.

The flexible soft magnetic core allow a flexion with respect to a longitudinal axis parallel to said wires and also with respect to a transversal axis perpendicular to said wires.

A second aspect of the invention relates to an antenna comprising at least one winding wound around a flexible soft magnetic core according to the first aspect of the invention.

A third aspect of the invention relates to a method for producing a flexible soft magnetic core as that of the first aspect of the invention.

BACKGROUND OF THE INVENTION

Currently, the main use of long ferrite cores is inner antennae in the fields of 10 KHz to 500 KHz. The effective permeability of a cylindrical core is proportional to the specific magnetic permeability of the material or $\mu_r$ times a form factor that is the L/D ratio, where L is the length and D is the diameter of the rod. This physical principle means that for the same ferromagnetic material, and antenna or inductor, has a larger inductance with product is longer and thinner, i.e. the L/D ratio is higher.

This principle led the designers to used ferrite cores with high L/D ratios that were wound with copper wire and then, protect the whole inductor by injecting it in a polymeric matrix or by casting it in a resin or, ultimately by providing an external protection in the form or a hard shell or box.

This solution obtained by common sinterization, and therefore being an intrinsically fragile solution, has been so far used in LF emitter antennas in Keyless entry systems for automotive as well as in induction soldering cannons and RF rod antenna for applications like atomic clock receivers among others.

The Young module (indicator of the elasticity of the ferrite) is very low, it means that ferrites are rigid and behave like glass or ceramic so they have fundamentally no deformation before cracking and braking.

A crack in a ferrite inside an antenna or inductor produces a high reluctance magnetic path of the field thus reducing the effective permeability and dropping the inductance, that if the application is a resonant tank for an antenna, leads to a higher self-resonant frequency of the tank that makes the circuit operate out of specifications or even do not operate at all as the energy transmitted to or by a not tuned tank can be too low to let the circuit operate as a signal transceiver.

To solve the above problems stacking foils of metallic soft magnetic materials have been used in this technical field These materials can be of several crystalline structures, including nano crystalline or amorphous alloys of Fe and other combinations of atomic Ni, Co, Cr or Mo or its multiple oxides. These solutions, known as laminations stacks or simply stacks are known for decades and have been massively used in electric 50 Hz and 60 Hz transformers among other applications. Metallic lamellae or bands in the form of stacks usually solve the problem of fragility but nevertheless, as they exhibit low ohmic resistivity, they need to be isolated from each other by isolating foils or layers of polymers, enamel, varnishes, and papers. A bendable antenna core is disclosed in US2006022886A1 and US2009265916A1 discloses an antenna core comprising a flexible stack of a plurality of oblong soft-magnetic strips consisting of an amorphous or nanocrystalline alloy. WO2012101034A1 discloses an antenna core being embodied in strip-shaped fashion and consisting of a plurality of metal layers composed of a nanocrystalline or amorphous, soft-magnetic metal alloy. In this case, the strip-shaped antenna core has a structure which extends along the transverse direction of the strip-shaped antenna core and which is elevated in a direction perpendicular to the plane of the strip-shaped antenna core EP0554581B1 discloses a flexible magnetic core and a method for producing the same, the latter comprising mixing in a vacuum a powder of small particles of soft magnetic material with a synthetic resin, and then curing of the resin in the form of a block applying during said curing a strong magnetic field thereto such that the particles form mutually insulated, longitudinally stretched, persistent chains parallel to the applied magnetic field. The mixing is performed in a vacuum The chains generated with such a method are provided by discrete powder particles with irregular cross-sections, the powder small particles having high probabilities of aggregating to each other between different chains unless very strong disaggregating agents and strong dispersant agents are used, as the mixture is in a very low viscosity form, this imposing severe complexity and cost. If chains of particles contact each other, there appear losses of charges (Foucault losses). And EP0554581B1 only provides as example of said soft magnetic material soft iron which is not suitable to operate to frequencies over 1 KHz.

U.S. Pat. No. 5,638,080A discloses an HF antenna comprising a sheet-like, flexible multipart magnet core manufactured of ferromagnetic material with an antenna winding which is made up of a plurality of turns and surrounds the magnet core. The turns of the antenna winding are formed by printed wiring arranged on a flexible film surrounding the magnet core. The magnet core is made up using individual plates, for example of insulated ferromagnetic material or amorphous alloy, which are embedded in a base material, also called carrier material, taking the form of a chain i.e. rigid elements (plates) connected by a flexible element (base material). Therefore the plates are not flexible and the flexibility of said magnetic core can be achieved only by the base material deformation on the direction perpendicular to said plates.

U.S. Pat. No. 5,159,347A discloses microscopic strips of high permeability magnetic conductor which are arrayed in a proximate relation to an electrical conductor to form paths for magnetic circuits about the electrical conductor. The strips may take various forms including filaments, such as one hundred micron microwire, and deposited submicron-sized layers of amorphous magnetic material. Moreover, the magnetic circuits may be closed with the strips forming a plurality of bands around the electrical conductor, and the magnetic circuits may be open, such as with the strips arrayed linearly adjacent to the electrical conductor. The magnetic circuits have numerous applications, including a variety of antennas, inductive wires, antenna ground planes, inductive surfaces, magnetic sensors, and direction finding arrays.

DESCRIPTION OF THE INVENTION

It is an object of the present invention to offer an alternative to the prior state of the art, with the purpose of providing a flexible soft magnetic core flexible in at least two orthogonal directions and a method for producing the same, which overcomes the drawbacks of the prior state of the art proposals.

To that end, according to a first aspect the present invention provides a flexible soft magnetic core comprising a ferromagnetic material arranged to form parallel magnetic continuous paths within the core made of a cured polymeric medium, with said parallel magnetic paths being electrically isolated from each other by said polymeric medium.

Contrary to the known flexible magnetic cores, particularly contrary to the one disclosed in the EP 0554581 B1, where the ferromagnetic material forming the parallel magnetic paths comprises chains of aligned discrete small magnetic particles, in the flexible soft magnetic core according the first aspect of the present invention, the ferromagnetic material forming the parallel magnetic paths comprises a plurality of parallel continuous ferromagnetic wires intrinsically flexibles embedded in a core body made of the polymeric medium that in an embodiment may be loaded with dispersed ferromagnetic nanoparticles, wherein the continuous ferromagnetic wires are spaced apart from each other, and extend from one end to another of the core body.

In one embodiment, the cured polymeric medium is an extruded part.

Preferably, the cured polymeric medium is a polymer-bonded soft magnetic material (PBSM). In addition, said cured polymeric medium, according to one embodiment, is a polymeric matrix obtained from epoxy or urethane or polyurethanes or polyamide derivatives including a liquid dispersing additive.

In one embodiment, said polymer-bonded soft magnetic material includes microfibers, microparticles or nanoparticles of a soft ferromagnetic material. In this case, the microfibers, microparticles or nanoparticles may be of a metal alloy of a very high relative permeability (e.g. between 100.000 and 600.000$\mu_r$) and based on a composition selected among FeNi or Mo—FeNi, or Co—Si, or Fe—NiZn with a weight content of the Ni from 30 to 80% and with the additional components including Mo, Co or Si with a weight content less than 10%. Alternatively, said microfibers, microparticles or nanoparticles may be selected from pure Fe 3+ or Fe carbonyl or Ni carbonyl or Mn Zn ferrite or Mn Ni ferrite or from a Mollypermalloy powder.

In another embodiment, the polymer-bonded soft magnetic material includes microfibers, microparticles or nanoparticles of soft ferromagnetic material that are present alone or in any combination among them within a polymeric matrix.

In yet another embodiment, the polymer-bonded soft magnetic material includes nanoparticles of soft ferromagnetic material that are of a crystalline structure and electrically isolated, and said crystalline structure is selected among an amorphous, nanocrystalline or macro crystalline with enlarged grains in an annealing process.

In any of the above described embodiments, the microfibers, microparticles or nanoparticles included in said bonded soft magnetic core may have a low magnetic coercivity, preferably but not limited to less than 0.1 A/m, and are electrically isolated by being encapsulated within the polymeric matrix with a resistivity ($\rho$) preferably, but not limited, of less than $10^6$ $\Omega\cdot$m.

In a preferred embodiment, each of said continuous ferromagnetic wires has a constant cross section along its whole length. Said constant cross section is for example circular having an area preferably in the range of 0.002 to 0.8 square millimeters.

In one embodiment, the flexible soft magnetic core comprises eight or more ferromagnetic wires, comprised by high/low aspect ratio preferably but not limited to less than 1000, and the continuous ferromagnetic wires are preferably arranged in several equidistant parallel geometric planes, with the particularity that the continuous ferromagnetic wires arranged in one of the geometric planes are staggered with respect to the ferromagnetic wires arranged in another adjacent parallel geometric plane.

The continuous ferromagnetic wires are made of a very high permeability value ferromagnetic material, such as, for example, an alloy of iron and one or more of Nickel, Cobalt, Molybdenum, and Manganese.

In one embodiment, the continuous ferromagnetic wires are bare ferromagnetic wires, while in another alternative embodiment the continuous ferromagnetic wires are wires coated by respective electrically isolating sheaths.

Preferably, said polymeric medium forming the core body is a polymeric matrix and in one embodiment the core body has a prismatic outer shape, such as a parallelepiped shape, although other shapes, such as a cylindrical shape, are envisaged.

According to a second aspect of the present invention, an antenna is provided comprising at least one winding wound around a flexible soft magnetic core which is flexible in al least two orthogonal axis according to the first aspect of the present invention.

According to a third aspect, the present invention provides a method for producing a flexible soft magnetic core, wherein said flexible soft magnetic core comprises continuous ferromagnetic wires embedded in a core body made of a polymeric medium that may be loaded with dispersed ferromagnetic nanoparticles, wherein the continuous ferromagnetic wires are spaced apart from each other, and extend from one end to another of the core body.

In contrast with the known methods, particularly regarding the one proposed by EP0554581B1 where small magnetic particles are embedded in the polymeric medium, the method according to the third aspect of the present invention comprises embedding continuous ferromagnetic wires into an uncured polymeric medium by means of a continuous extrusion process of the polymeric medium around and in between said wires, curing the polymeric medium with the continuous ferromagnetic wires embedded therein to form a continuous core precursor, and cutting said continuous core precursor into discrete soft magnetic cores.

For a preferred embodiment, the method of the third aspect of the invention comprises producing the flexible soft magnetic core by means of a continuous extrusion process comprising passing the continuous ferromagnetic wires together with a polymeric medium casting through an extrusion chamber.

According to an embodiment, the method comprises aligning and ordering the continuous ferromagnetic wires previously to their pass through said extrusion chamber, by, for an implementation o said embodiment, making them pass through several holes and/or including an axial magnetic induction on the cured polymer, said several holes being arranged according to a requested order in a wire feed-in plate.

The method comprises, according to an embodiment, making the continuous ferromagnetic wires pass through said holes of the wire feed-in plate and through the extrusion chamber by pulling the continuous ferromagnetic wires while pushing the polymeric medium, in viscous form, into the extrusion chamber and towards the extrusion chamber, and the through-holes of the holes of the wire feed-in plate being configured and arranged to avoid the polymeric medium passing there through.

In one embodiment, said continuous extrusion process comprises passing the continuous ferromagnetic wires through an extrusion chamber while the polymeric medium is extruded through said extrusion chamber.

Preferably, the continuous ferromagnetic wires are kept aligned with the extrusion chamber and arranged according to a predetermined pattern while passing through said extrusion chamber by making the continuous ferromagnetic wires pass through several holes arranged according to said predetermined pattern in a wire feed-in plate located at one end of the extrusion chamber opposite to an outlet end thereof.

The continuous ferromagnetic wires are made to pass through said holes of the wire feed-in plate and through the extrusion chamber towards said outlet end by pulling the continuous ferromagnetic wires with the uncured polymeric medium (that may be loaded with dispersed ferromagnetic nanoparticles), which is injected in viscous form into the extrusion chamber from a polymer feed-in passage located in a side wall of the extrusion chamber. Preferably, the holes of the wire feed-in plate are configured and arranged to fit to the continuous ferromagnetic wires and to avoid the polymeric medium passing back therethrough.

In one embodiment, the former ends of the continuous ferromagnetic wires are connected to a plunger slidably arranged within the extrusion chamber and located downstream of said polymer feed-in passage and upstream of the wire feed-in plate. The continuous ferromagnetic wires are connected to the plunger said plunger at positions thereof arranged according to said predetermined pattern, so that the plunger keeps the continuous ferromagnetic wires aligned with the extrusion chamber and arranged according to the predetermined pattern while pulling the continuous ferromagnetic wires along the extrusion chamber at the start of an extrusion operation. The plunger, once it has come out of the extrusion chamber, is then eliminated by cutting a former end of the continuous core precursor.

The continuous core precursor is cooled by means of a cooling device outside the extrusion chamber before cutting. Optionally, the continuous core precursor is pooled by a pooling device located downstream of the cooling device before cutting. Preferably, each of the continuous ferromagnetic wires is pushed by a pushing device located upstream of the wire feed-in plate.

BRIEF DESCRIPTION OF THE DRAWINGS

The previous and other advantages and features will be better understood from the following detailed description of embodiments, with reference to the attached drawing, which must be considered in an illustrative and non-limiting manner, in which.

DETAILED DESCRIPTION OF EXEMPLARY EMBODIMENTS

Figure 1:
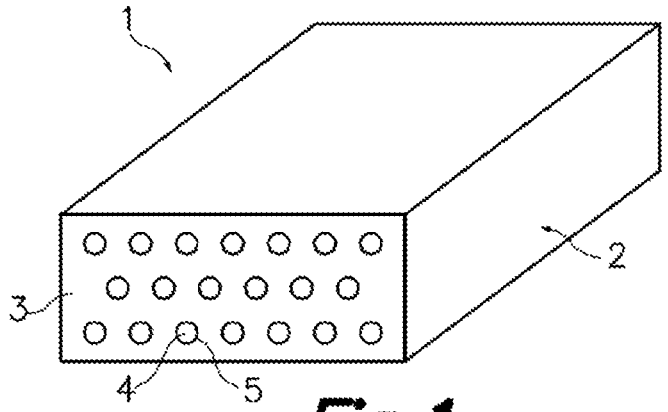
FIG. 1 is a perspective view of a flexible soft magnetic core according to an embodiment of the present invention.

Referring first to FIG. 1, a flexible soft magnetic core 1 according to an embodiment of the first aspect of the present invention is shown. The core body 2 can have a prismatic or cylindrical outer shape.

According to an embodiment the cured polymeric medium 3 including the plurality of ferromagnetic wires is an extruded part, elongated along an axis, being twistable and flexible along two orthogonal planes which intersect defining said axis.

The flexible soft magnetic core 1 comprises parallel continuous ferromagnetic wires 4 that are flexible wires, embedded in a core body 2 made of a polymeric medium 3, such as a polymeric matrix. Said continuous ferromagnetic wires 4 are spaced apart from each other and extend from one end to another of said core body 2, so that the continuous ferromagnetic wires 4 are electrically insulated from each other by the polymeric medium 3.

The soft magnetic core has a length longer than 15 cm and preferably longer than 25 cm (for example 30 cm and more) so that in the case of the core being applicable to an antenna for a vehicle a reduction of number of antennas per vehicle from 5 to 2 can be achieved with up to 4 times longer thinner antennas.

In an embodiment the cured polymeric medium (3) is a polymer-bonded soft magnetic material PBSM.

In another embodiment the polymeric medium is a polymeric matrix obtained from epoxy or urethane or polyurethanes or polyamide derivatives.

Each of said continuous ferromagnetic wires 4 has a constant cross section 5 along its whole length, wherein said constant cross section is a circular cross section having an area in the range of 0.002 to 0.8 square millimeters. Alternatively, the constant cross section is a polygonal cross section having an area within the same range.

The flexible soft magnetic core 1 shown in FIG. 1 comprises twenty continuous ferromagnetic wires 4, although at least eight continuous ferromagnetic wires 4 per core is considered enough.

As per one embodiment a flexible magnetic core comprises at least eight ferromagnetic wires (4) comprised by high/low aspect ratio preferably of less than 1000 (having the wires a diameter of 20 microns and a length of 20 cm).

In the disclosed embodiment the continuous ferromagnetic wires 4 are arranged within the core body 2 made of the polymeric medium 3 in several equidistant parallel geometric planes, wherein the continuous ferromagnetic wires 4 arranged in one geometric plane are staggered with respect to the ferromagnetic wires 4 arranged in another adjacent parallel geometric plane. This provides regular and uniform distances between the continuous ferromagnetic wires 4.

The continuous ferromagnetic wires 4 are made of a very high permeability (values are in the range from 22.5 to 438 $\mu m/mH \cdot m^{-1}$) ferromagnetic material, such as, for example, an alloy of Nickel, Cobalt and Manganese. In the embodiment shown in FIG. 1, the continuous ferromagnetic wires 4 are bare ferromagnetic wires. However, in an alternative embodiment (not shown) the continuous ferromagnetic wires 4 are wires coated by respective electrically isolating sheaths. In the embodiment shown in FIG. 1, the core body 2 has a prismatic or parallelepiped outer shape. However, in an alternative embodiment (not shown) the core body 2 has a cylindrical outer shape.

The continuous ferromagnetic wires 4 used have a constant cross section 5 along its whole length, said constant cross section being circular having an area in the range of 0.002 to 0.8 square millimeters.

As per another embodiment the continuous ferromagnetic wires 4 are arranged in several equidistant parallel geometric planes, wherein the continuous ferromagnetic wires 4 arranged in one geometric plane are staggered with respect to the ferromagnetic wires 4 arranged in another adjacent parallel geometric plane.

Figure 2:
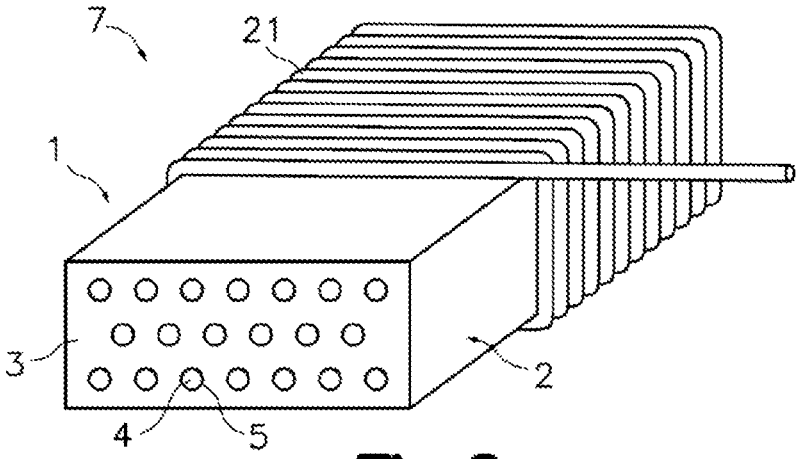
FIG. 2 is a perspective view of a coil for an antenna according to an embodiment of the present invention, including the flexible soft magnetic core.

In an example the continuous ferromagnetic wires (4) are made of a ferromagnetic material having a very high permeability in the range of 22.5 to 438 $\mu m/mH \cdot m^{-1}$, such an alloy of iron and one or more of Nickel, Cobalt, Molybdenum, and Manganese As per one embodiment the continuous ferromagnetic wires can be also electrically insulated by a coating of a glaze or enamel Referring now to FIG. 2, a coil for an antenna 7 according to an embodiment of the third aspect of the present invention is shown. The antenna coil 7 comprises a flexible soft magnetic core 1 as the one described above with reference to FIG. 1 and at least one winding 21 wound about the flexible soft magnetic core 1. The winding 21 is made of a conductor material and is either coated with an isolating layer or the winding 21 of the coil 7 are spaced apart from each other in order to avoid contact therebetween. When an electric current is applied to the winding 21 a magnetic flow is induced along the continuous ferromagnetic wires 4 in the flexible soft magnetic core 1.

FIGS. 3, 4, 5 and 6 illustrate a method for producing a flexible soft magnetic core 1 according to an embodiment of the third aspect of the present invention.

Figure 8:
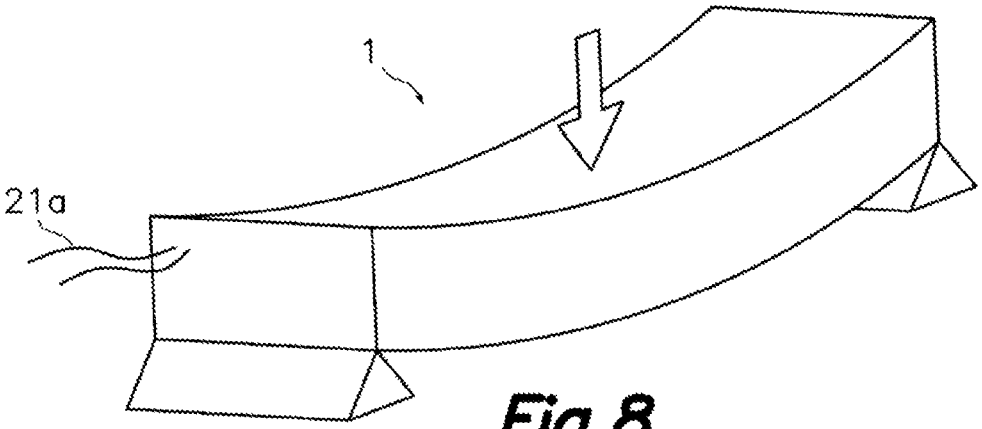
FIGS. 8 and 9 are perspective views showing flexion and torsion of the proposed soft magnetic core according to the invention.
Figure 9:
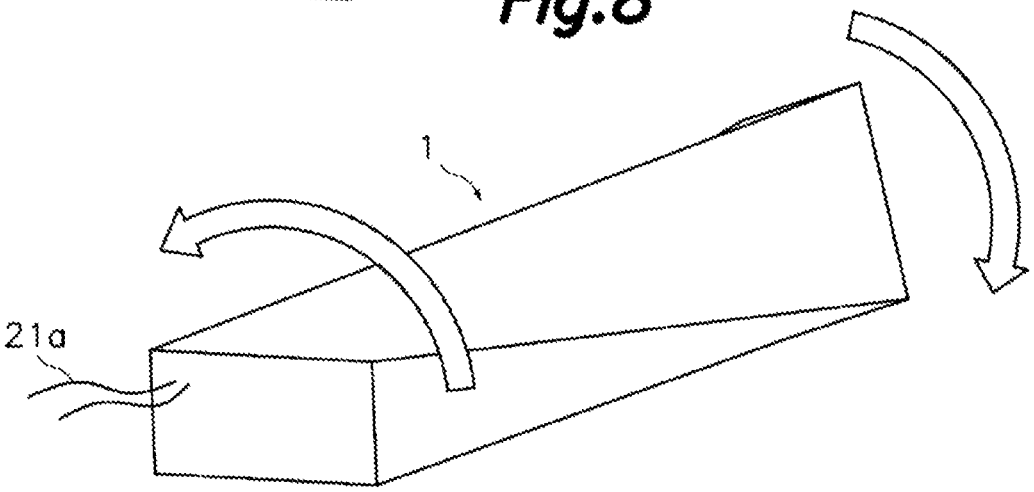

Therefore the cured polymeric medium 3 including the plurality of ferromagnetic wires is an extruded part, elongated along an axis, being twistable and flexible (see FIGS. 8 and 9) along two orthogonal planes which intersect defining said axis.

Figure 3:
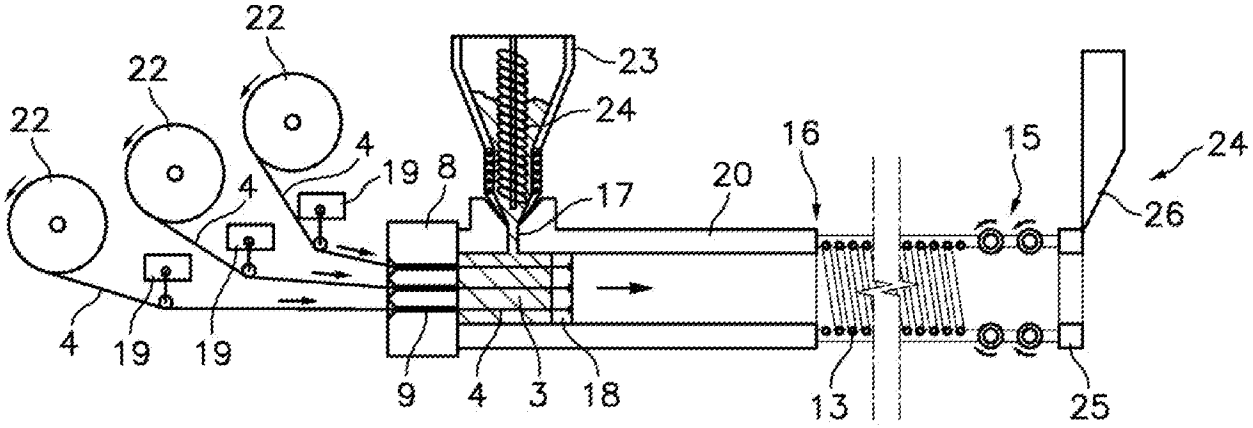
FIGS. 3, 4, 5 and 6 are side sectional views illustrating successive stages of a possible method for producing continuously a flexible soft magnetic core according to an embodiment of the present invention.

With regard to the method In a first stage shown is FIG. 3, the method comprises making a plurality continuous ferromagnetic wires 4, which are unwound from respective reels 22, pass through several holes 9 arranged according to a predetermined pattern in a wire feed-in plate 8 located at one end of an extrusion chamber 20. The extrusion chamber 20 has an elongated straight stretch having a constant cross-section with an outlet end 16 opposite to the wire feed-in plate 8. Each of the continuous ferromagnetic wires 4 is pushed into the extrusion chamber 20 by a corresponding pushing device 19 located upstream of the wire feed-in plate 8.

A polymer feed-in passage 17 is located in a side wall of the extrusion chamber 20. Said polymer feed-in passage 17 is connected to an outlet of a hopper 23 with controlled heating, containing uncured polymeric medium 3 in a fused state and a worm 24 in the hopper 23 is arranged to thrust the uncured fused polymeric medium 3 into the extrusion chamber 20 (thermally isolated) through polymer feed-in passage 17.

At the start of an extrusion operation, the former ends of the continuous ferromagnetic wires 4 are connected to a plunger 18 slidably arranged within the extrusion chamber 20 and located downstream of said polymer feed-in passage 17. The former ends of the continuous ferromagnetic wires 4 are connected to the plunger 18 at locations thereof arranged according to same predetermined pattern as the holes 9 in the wire feed-in plate 8.

Thus, the wire feed-in plate 8 and the plunger 18 keep the continuous ferromagnetic wires 4 aligned with the extrusion chamber 20 and arranged according to the predetermined pattern while the plunger 8 pulls the continuous ferromagnetic wires 4 along the extrusion chamber 20 under the pressure exerted by the uncured polymeric medium 3 being injected in viscous form through the polymer feed-in passage 17 into the extrusion chamber 20 between the feed-in plate 8 and the plunger 18, with the uncured polymeric medium 3 embedding the continuous ferromagnetic wires 4.

By continuously feeding the uncured polymeric medium 3 into the extrusion chamber, the plunger 18 is moved to the outlet end 16 pulling the continuous ferromagnetic wires 4 so that a continuous core precursor 10 begins to be formed. The holes 9 of the wire feed-in plate 8 are configured and arranged to fit to the continuous ferromagnetic wires 4 and to avoid the polymeric medium 3 passing back therethrough.

Figure 4:
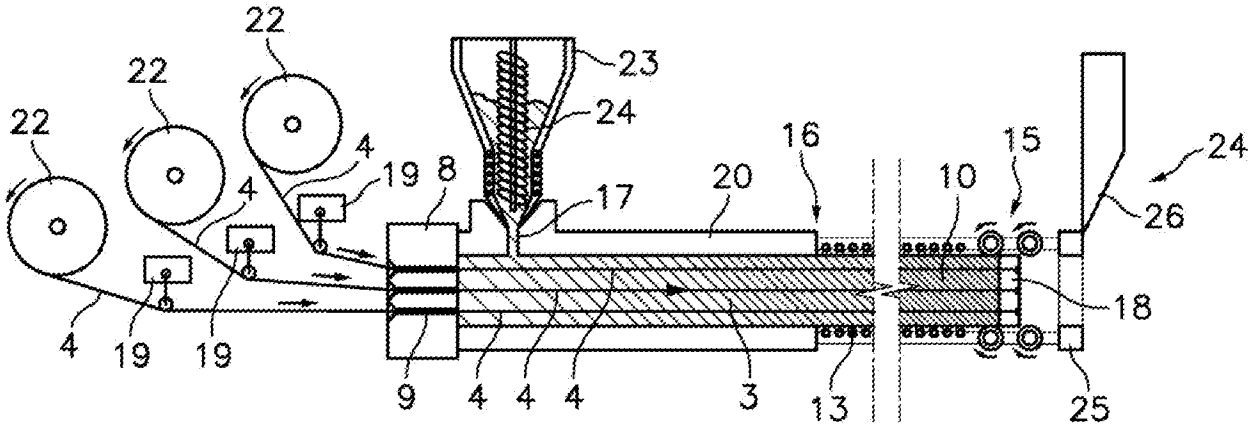

FIG. 4 illustrates a second stage of the method in which the former end of the continuous core precursor 10 with the plunger 18 attached thereto has come out the extrusion chamber 20 through the outlet end 16 and the continuous core precursor 10 is cooled 1 by means of a cooling device 13 located outside the extrusion chamber adjacent to the outlet end 16. In the illustrated embodiment, the cooling device 13 comprises a coiled duct along which a cooled heat transfer fluid flows. However, the cooling device 13 can alternatively comprise other cooling means.

The continuous core precursor 10 is additionally pooled by a pooling device 15 located outside the extrusion chamber 20 downstream of the cooling device 13 and adjacent thereto. In the FIGS. 3, 4, 5 and 6, the polymeric medium 3 is shown shaded by parallel hatch lines representing the level of curing, with distances between the parallel hatch lines being narrower as the polymeric medium 3 becomes more and more cooled and solidified.

Figure 5:
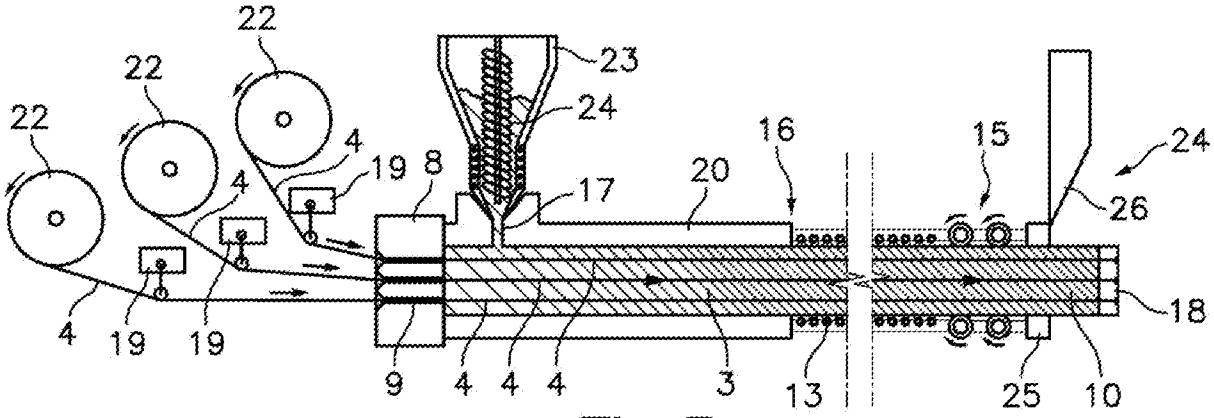

FIG. 5 illustrates a third stage of the method in which the former end of the continuous core precursor 10 with the plunger 18 attached thereto has been passed through a cutting device 24. In the illustrated embodiment, the cutting device 24 comprises an anvil 25 having an opening through which the continuous core precursor 10 passes, and a cutting blade 26 actuated to severe the continuous core precursor 10 adjacent the anvil 25. However, the cutting device 24 can alternatively comprise other cutting means such a laser or a water jet cutting.

Figure 6:
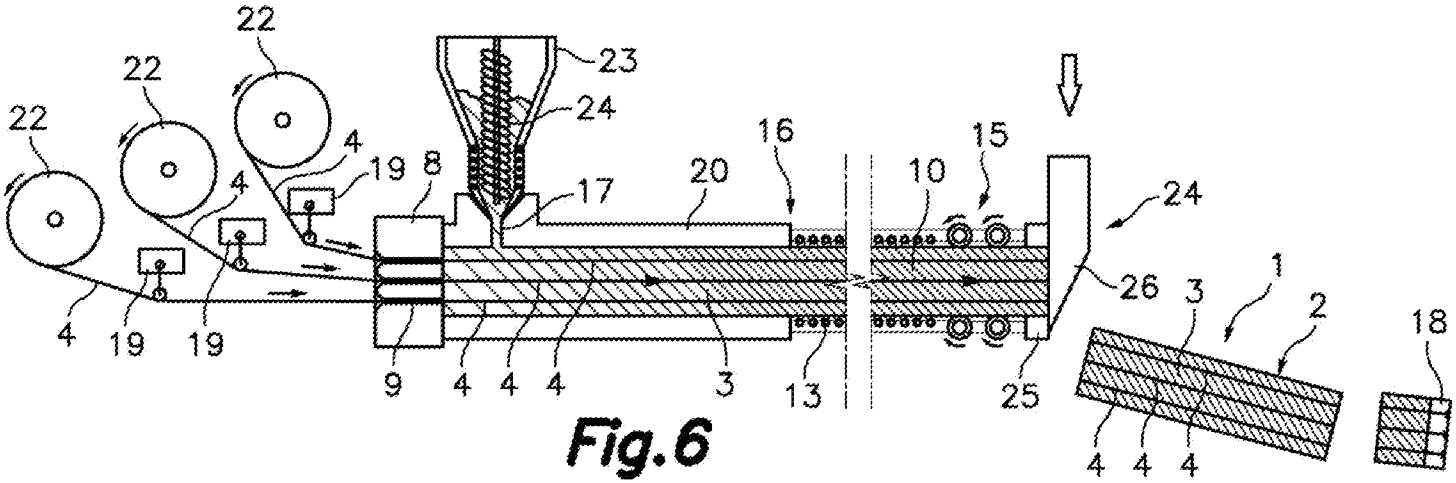

FIG. 6 illustrates a fourth and last stage of the method in which the former end of the continuous core precursor 10 with the plunger 18 attached thereto has been severed from the continuous core precursor 10 by means of the cutting device 24 and then successive flexible soft magnetic cores 1 are formed by repeatedly cutting the continuous core precursor 10 with the cutting device 24 as the continuous core precursor 10 comes out the extrusion chamber 20. The former end of the continuous core precursor 10 with the plunger 18 attached thereto is rejected. The obtained subsequent flexible soft magnetic cores 1 are as described above with reference to FIG. 1.

Thus, the method of the present invention comprises embedding continuous ferromagnetic wires 4 into an uncured and fluid (fused) polymeric medium 3 by means of a continuous extrusion process, curing the polymeric medium 3 with the continuous ferromagnetic wires 4 embedded therein to form a continuous core precursor 10, and cutting said continuous core precursor 10 into discrete soft magnetic cores 1. The continuous ferromagnetic wires 4 are through an extrusion chamber while the polymeric medium 3 is extruded through said extrusion chamber 20.

The present invention proposes a core that has the same effectively cross sectional area than the laminations stack that, as claimed in the US2006022886A1 and US2009265916A1 patents can be as much as 80% smaller due to the higher flux density B that these alloys can withstand. Typically ferrite Bsat is 0.3 T while Ni based alloys can withstand 5 fold Bsat up to 1.5 T and other materials like Permalloy 79Ni4MoFe can be 2×Bsat as per below table:

TABLE 1

| Chemical | Grade | Saturation induction Bs/T | Rs Br/Bm | CurieTemp Tc/° C. | Coercive force Hc/A · m$^{-1}$ | Initial Perme-ability mH · m$^{-1}$ | Max Perme-ability μm/mH · m$^{-1}$ | Resistivity μΩ · cm |
|---|---|---|---|---|---|---|---|---|
| 46NiFe | | ≥1.50 | 0.75 | 400 | ≤12 | 2.5-4.5 | 22.5-45 | 45 |
| 50NiFe | | ≥1.50 | 0.72 | 500 | ≤8.8 | 2.8-5.9 | 31-65 | 45 |
| 65Ni2.5MoFe | | ≥1.20 | ≥0.9 | 530 | ≤6.4 | — | 200-438 | 45 |
| 76Ni5Cu2CrFe | | ≥0.75 | — | 400 | ≤4.8 | 18.8-31.3 | 75-225 | 55 |
| 77Ni4Mo5CuFe | | ≥0.60 | — | 350 | ≤2.0 | 37.5-75.0 | 175-312 | 55 |
| 79Ni4MoFe | 79 Permalloy | ≥0.75 | — | 450 | ≤4.8 | 15-32 | 87.5-275 | 55 |
| 80Ni3CrFe | | ≥0.65 | — | 330 | ≤4.8 | 17.5-44 | 75-200 | 62 |
| 80Ni5MoFe | | ≥0.70 | — | 400 | ≤4.8 | 20-75 | 87.5-325 | 56 |
| 81Ni6MoFe | | ≥0.60 | — | — | ≤4.0 | 12.5-62.5 | 100-250 | 60 |

For a given current I the magnetic field intensity H is proportional to the cross sectional area S of the core and the number of turns. The maximum H is limited by saturation Bsat. As Bsat is from 2 folds to 5 folds larger for the same H, cross sectional area of the core S can be reduced proportionally or, if kept the same, less winding turns are needed for the same magnetic induction thus helping to have either smaller antennae or with less windings.

Figure 1A:
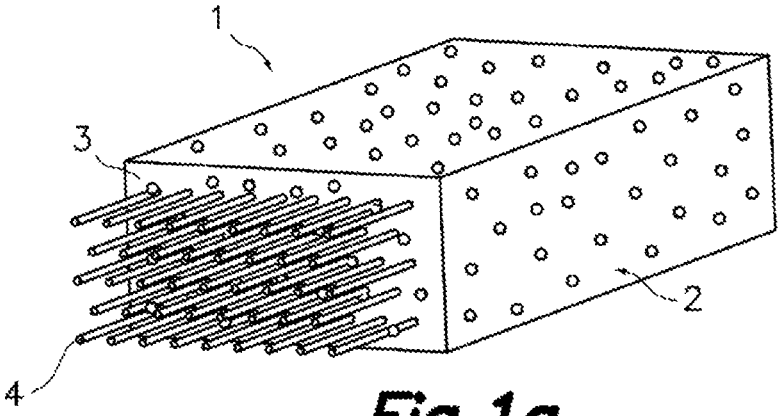
FIG. 1*a* is a perspective view of a flexible soft magnetic core according to an embodiment of the present invention including nanoparticles embedded on the ferromagnetic core.
Figure 7:
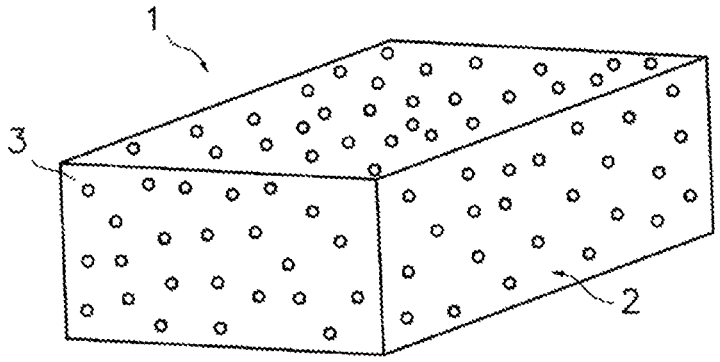
FIG. 7 is a perspective view of a flexible soft magnetic core according to an embodiment including nanoparticles and without wires on said core.

According an additional embodiment shown in FIGS. 1*a* and 7, the flexible soft magnetic core of the present invention include nanoparticles embedded on the ferromagnetic core in order to increase the magnetic properties of the soft magnetic core. The features, composition and capacities of said nanoparticles have been above exposed, for example regarding to the nanoparticles size, permeability, alloy composition, etc.

According to a preferred embodiment the cured polymeric medium 3 further includes microfibers, microparticles or nanoparticles of a soft ferromagnetic material that are present alone or in any combination among them within the polymeric matrix of said polymeric medium 3.

The microfibers, microparticles or nanoparticles of a soft ferromagnetic material used represent weight content up to 85% of the total weight of the core.

The microfibers, microparticles or nanoparticles of soft magnetic material are homogeneously distributed and electrically insulated within the polymeric matrix of said polymeric medium (3) by means of one or more dispersant agents incorporated to the uncured liquid polymeric medium along with said microfibers, microparticles or nanoparticles.

In an embodiment the cited dispersant is present in an amount of around 4-5% of the liquid polymer providing said core body.

Moreover said one or more dispersant agents comprises Solsperse from Lubrizol.

As per one embodiment one or more dispersant agents comprises a liquid monomer or a hyperdispersant providing to said microfibers, microparticles or nanoparticles a surface treatment involving an electric insulation in addition to the dispersing action.

The microfibers, microparticles or nanoparticles are of a metal alloy of a very high relative permeability, preferably of less than 600.000, and based on a composition selected among FeNi or Mo—FeNi, or Co—Si, or Fe—NiZn with a weight content of the Ni from 30 to 80% and with the additional components including Mo, Co or Si with a weight content less than 10%.

The microfibers, microparticles or nanoparticles are selected from pure Fe, pure $Fe^{3+}$, or Fe carbonyl or Ni carbonyl or Mn Zn ferrite or Mn Ni ferrite or from a Mollypermalloy powder.

Besides, the microparticles or nanoparticles of soft ferromagnetic material that are of a crystalline structure selected among an amorphous, nanocrystalline or macro crystalline with enlarged grains in an annealing process.

And the cited microfibers, microparticles or nanoparticles have a low magnetic coercitivity, preferably of less than 0.1 A/m, and are electrically insolated within the polymeric matrix with a resistivity (ρ) preferably of less than $10^6$ In the embodiment of the FIG. 1*a*, a plurality of parallel continuous ferromagnetic wires made of a very high permeability value ferromagnetic material are embedded on said ferromagnetic core, instead in the FIG. 7 embodiment the ferromagnetic core lacks of said continuous ferromagnetic wires, being their functionality supplied by nanoparticles embedded on the ferromagnetic core.

The invention claimed is:

1. Flexible soft magnetic core including a ferromagnetic material arranged to form parallel magnetic paths within a core body that is made of a cured polymeric medium, said parallel magnetic paths being electrically insulated from each other by said polymeric medium, wherein said ferromagnetic material comprises a plurality of parallel, continuous, ferromagnetic elements embedded in said core body made of said polymeric medium, wherein said continuous ferromagnetic elements are spaced apart from each other and extend from one end to another end of said core body and characterized in that:

said core is elongated along a longitudinal axis and flexible in at least two orthogonal directions; and said continuous, ferromagnetic elements are flexible wires;

whereby said core allowing a flexion with respect to said longitudinal axis parallel to said wires and also with respect to a transversal axis perpendicular to said wires.

2. The flexible soft magnetic core according to claim 1, wherein said cured polymeric medium including the plurality of ferromagnetic wires is an extruded part, elongated along an axis, being twistable and flexible along two orthogonal planes which intersect defining said axis.

3. The flexible soft magnetic core according to claim 2, wherein said core has a length longer than 15 cm and the core body is of a prismatic or cylindrical shape.

4. The flexible soft magnetic core according to claim 1 wherein said cured polymeric medium is a polymer-bonded soft magnetic material PBSM.

5. The flexible soft magnetic core according to claim 1 wherein said cured polymeric medium further includes microfibers, microparticles or nanoparticles of a soft ferromagnetic material that are present alone or in any combination thereof, within the polymeric matrix of said polymeric medium.

6. The flexible soft magnetic core according to claim 5, wherein said microfibers, microparticles or nanoparticles of a soft ferromagnetic material represent a weight content up to 85% of the total weight of the core and wherein said microfibers, microparticles or nanoparticles of soft magnetic material are homogeneously distributed and electrically insulated within a polymeric matrix of said polymeric medium by means of one or more dispersant agents incorporated to the uncured liquid polymeric medium along with said microfibers, microparticles or nanoparticles.

7. The flexible soft magnetic core according to claim 5, wherein said one or more dispersant agents are present in an amount of around 4-5% of the liquid polymer providing said core body and wherein said dispersant agents comprises Solsperse from Lubrizol or a liquid monomer or a hyperdispersant providing to said microfibers, microparticles or nanoparticles a surface treatment involving an electric insulation in addition to the dispersing action.

8. The flexible soft magnetic core according to claim 5 wherein said microfibers, microparticles or nanoparticles are of a metal alloy of a very high relative permeability of less than 600.000, and based on a composition of FeNi, Mo—FeNi, Co—Si, or Fe—NiZn with a weight content of the Ni from 30 to 80% and with additional components including Mo, Co or Si with a weight content less than 10%.

9. The flexible soft magnetic core according to claim 5, wherein said microfibers, microparticles or nanoparticles are selected from the group consisting of pure $Fe^{3+}$, Fe carbonyl, Ni carbonyl, Mn Zn ferrite, Mn Ni ferrite and a Mollypermalloy powder.

10. The flexible soft magnetic core according to claim 5 wherein said microparticles or nanoparticles of soft ferromagnetic material that are of a crystalline structure comprise an amorphous, nanocrystalline or macro crystalline with enlarged grains in an annealing process.

11. The flexible soft magnetic core according to claim 5 wherein said microfibers, microparticles or nanoparticles have a low magnetic coercitivity of less than 0.1 A/m, and are electrically insolated within the polymeric matrix with a resistivity (ρ) of less than $10^6$ Ω·m.

12. An antenna, comprising a flexible soft magnetic core according to claim 5 and at least one winding wound around the flexible soft magnetic core.

13. The flexible soft magnetic core according to claim 1 wherein said polymeric medium is a polymeric matrix obtained from epoxy or urethane or polyurethanes or polyamide derivatives.

14. The flexible soft magnetic core according to claim 13, wherein said continuous ferromagnetic wires are electrically insulated by a coating of a glaze or enamel.

15. The flexible soft magnetic core according to claim 1, wherein each of said continuous ferromagnetic wires has a constant cross section along its whole length, said constant cross section being circular and having an area in the range of 0.002 to 0.8 square millimeters.

16. The flexible soft magnetic core according to claim 15, wherein said continuous ferromagnetic wires are arranged in several equidistant parallel geometric planes, wherein the continuous ferromagnetic wires arranged in one geometric plane are staggered with respect to the ferromagnetic wires arranged in another adjacent parallel geometric plane.

17. The flexible soft magnetic core according to claim 1, wherein the continuous ferromagnetic wires are made of a ferromagnetic material having a very high permeability in the range of 22.5 to 438 $\mu m/mH \cdot m^{-1}$, and wherein said very high permeability ferromagnetic material is an alloy of iron and one or more of nickel, cobalt, molybdenum, and manganese.

18. A method for producing a flexible soft magnetic core, the method comprising:

embedding continuous ferromagnetic wires into an uncured polymeric medium by means of a continuous extrusion process, curing the polymeric medium with the continuous ferromagnetic wires embedded therein to form a continuous core precursor, and cutting said continuous core precursor into discrete magnetic soft cores, wherein said continuous extrusion process comprises passing the continuous ferromagnetic wires through an extrusion chamber while the polymeric medium is extruded through said extrusion chamber.

19. The method according to claim 18, wherein the continuous ferromagnetic wires are kept aligned with the extrusion chamber and arranged according to a predetermined pattern while passing through said extrusion chamber by making the continuous ferromagnetic wires pass through several holes and/or including an axial magnetic induction on the cured polymer, said several holes being arranged according to said predetermined pattern in a wire feed-in plate located at one end of the extrusion chamber opposite to an outlet end thereof and wherein the continuous ferromagnetic wires are made to pass through said holes of the wire feed-in plate and through the extrusion chamber towards said outlet end by pulling the continuous ferromagnetic wires with the uncured polymeric medium, loaded with dispersed ferromagnetic microfibers, microparticles or nanoparticles, being injected in viscous form into the extrusion chamber from a polymer feed-in passage located in a side wall of the extrusion chamber and wherein each of the continuous ferromagnetic wires is pushed by a pushing device located upstream of the wire feed-in plate.

20. The method according to claim 18, wherein former ends of the continuous ferromagnetic wires are connected to a plunger slidably arranged within the extrusion chamber and located downstream of said polymer feed-in passage, said plunger keeping the continuous ferromagnetic wires aligned with the extrusion chamber and arranged according to said predetermined pattern while pulling the continuous ferromagnetic wires along the extrusion chamber at the start of an extrusion operation, said plunger being then eliminated by cutting at least a former end of the continuous core precursor and wherein the continuous core precursor is cooled by means of a cooling device outside the extrusion chamber before cutting and the continuous core precursor is pooled by a pooling device located downstream of the cooling device before cutting.

* * * * *